United States Patent [19]

Osberghaus et al.

[11] Patent Number: 4,863,299

[45] Date of Patent: Sep. 5, 1989

[54] APPLICATOR FOR LIQUID FLOOR TREATMENT PREPARATIONS

[75] Inventors: Rainer Osberghaus, Duesseldorf; Franz Kresse, Hilden; Bernfrid Scheller, Pulheim, all of Fed. Rep. of Germany

[73] Assignee: Henkel Kommanditgesellschaft auf Aktien, Duesseldorf, Fed. Rep. of Germany

[21] Appl. No.: 197,871

[22] Filed: May 24, 1988

[30] Foreign Application Priority Data

May 29, 1987 [DE] Fed. Rep. of Germany ..... 3718141

[51] Int. Cl.[4] ..... A47L 13/22

[52] U.S. Cl. ..... 401/15; 401/138; 401/140; 401/275; 222/108; 141/20.5; 141/311 A; 141/339

[58] Field of Search ..... 401/15, 138, 205, 140, 401/137, 270, 273, 275; 222/108, 109, 164–166, 192; 141/18, 20.5, 311 R, 311 A, 339; 15/147 R

[56] References Cited

U.S. PATENT DOCUMENTS

| | | | |
|---|---|---|---|
| 1,245,714 | 1/1918 | McCombs | 401/15 X |
| 1,426,846 | 8/1922 | Craig | 222/192 |
| 2,037,349 | 4/1936 | Svetlik | 401/138 X |
| 2,061,216 | 11/1936 | Thompson | 401/138 |
| 2,187,671 | 1/1940 | Suddarth | 401/205 |
| 2,768,401 | 10/1956 | Becker et al. | 401/138 X |
| 2,940,104 | 6/1960 | Jenkins | 401/138 |
| 3,081,481 | 3/1963 | Nohl et al. | 401/138 |
| 3,457,016 | 7/1969 | Gotberg | 401/138 X |
| 4,603,450 | 8/1986 | Osberghaus et al. . | |
| 4,680,826 | 7/1987 | Schunter . | |

FOREIGN PATENT DOCUMENTS

| | | | |
|---|---|---|---|
| 2932110 | 2/1981 | Fed. Rep. of Germany | 401/138 |
| 3411858 | 8/1985 | Fed. Rep. of Germany . | |
| 3432685 | 3/1986 | Fed. Rep. of Germany . | |
| 27516 | 2/1903 | Switzerland | 401/232 |

*Primary Examiner*—Richard J. Apley
*Assistant Examiner*—David J. Bender
*Attorney, Agent, or Firm*—Ernest G. Szoke; Wayne C. Jaeschke; Real J. Grandmaison

[57] ABSTRACT

A container for liquid floor treatment preparations adapted to be mounted at its back to the handle of a long-handled floor wiper, wherein the container includes a return flow cutoff funnel with an inlet, and a lower outlet tube with an exit port coupled to one end of a flexible hose that is selectively kinked to prevent fluid flow from the container to the floor, or unkinked to obtain such fluid flow.

20 Claims, 1 Drawing Sheet

APPLICATOR FOR LIQUID FLOOR TREATMENT PREPARATIONS

BACKGROUND OF THE INVENTION

1. Field of the Invention

This invention relates to an applicator for floor-cleaning and floor-care preparations, more especially self-shining emulsions. It comprises a floor wiper which is fixed to a handle fitted with a wiping head or the like, to which the applicator is attached, as well as the handle, applicator, and wiper combination.

2. Statement of Related Art

A floor wiper useful in this invention is described in U.S. Pat. No. 4,603,450 (and corresponding published German application No. 34 11 858). The known appliance comprises two frame sections which are designed to be folded towards one another about a pivoting axis and to be held in position by means of a locking mechanism. One of the frame sections is T-shaped while the other frame section is U-shaped to make the T into a substantially rectangular plate. The pivoting axis extends substantially perpendicularly of the longitudinal axis of the arms of the T or U. Finally, the appliance comprises a magnetic-clamp lock.

Another floor wiper is described in U.S. Pat. No. 4,680,826 (and corresponding published German application No. 34 32 685). This appliance also comprises a frame having two frame sections designed to be pivoted relative to one another and to be locked in position by a magnetic-clamp lock. A pedal is arranged on one of the frame sections of the wiper. This pedal acts on the other frame section and is movable in the direction in which the two frame sections are divided to enable the magnetic-clamp lock to be released more easily and, as a result, the wiper to be opened more quickly.

Floor-cleaning and floor-care preparations, particularly self-shine emulsions, may be applied relatively uniformly by means of the above and other known appliances. However, a problem lies in the supply of the particular treatment preparation to be distributed over the floor by the wiper. For example, emulsions, or the like, are poured onto the floor from canisters and distributed by the applicator. The films applied can have different thicknesses. Overdosage and underdosage can lead to streaks or bubble formation. Where emulsions in particular are applied, it is difficult to apply a second or third coating because the emulsion applied dissolves the first film so that any retouching necessary has to be carried out quickly and with considerably dexterity. Finally, the moist wiping heads, or the like, used generally bind from 500 to 800 g of the treatment preparation which is thus lost to the actual cleaning process.

SUMMARY OF THE INVENTION

The present invention improves and completes the known floor wipers in such a way that floor treatment preparations can be applied evenly or with controlled uneveness and a second or third coating can be applied without any danger of significant damage to the first or second coating.

The invention comprises a longitudinal container for the liquid floor preparations whose back may be mounted on the handle of a commercially available long-handled floor wiper. The container has inlet means at its top (preferably integral therewith) for introducing the liquid, and then cuting off its return flow during use of the inventive device.

This inlet means is preferably a funnel directed into the container, whose lip is integral with the top of the container (ideally in the same plane), and proximal to the container front. Ideally, the front top edge of the container also comprises a segment of the funnel lip. The slope of the funnel should be downward from the container front to the container back, and the funnel exit mouth should be within the container located sufficiently far from the container front (i.e., close to the container back), as to prevent an outflow of the liquid when or if the container is tilted forward in use.

The outlet means comprises an exit hole in the container, preferably at that point of the container which will be lowest when it is tilted forward in operating position, thus assuring maximum evacuation of the liquid. The exact location of the exit hole will necessarily vary with the configuration of the container. The outlet means further comprises: a hose coupler (nipple, olive, etc.) surrounding and projecting distally from the exit hole; a replaceable flexible hose removeably attached at one end to the projecting end of the coupler, and preferably, a nozzle attached to the other (free) end of the hose.

The inventive device most importantly also comprises closing means for releasably kinking the hose sufficiently so that it may be closed to fluid communication. The preferred means for kinking the hose is a "Bowden Wire" or Cable, which is defined in mechanical engineering art as a wire made of spring steel which is enclosed in a (preferably helical) casing, and which is used to transmit longitudinal motions over distances, particularly around corners. Because the manner of closing-off the liquid flow does not involve any moving parts which come into contact with the floor treatment preparations (other than the hose itself), the blockage of moving parts by accumulated dried treatment preparations is completely avoided.

The inventive applicator is fixed to a handle fitted with a wiping head, or the like. Alternatively, this invention comprises the operative combination of handle means ending in wiper means, and the applicator as described attached to the handle means. The applicator itself is a container for the floor-cleaning or floorcare preparation with an exit pipe leading to the floor. The container comprises a permanently open filling funnel (i.e. filling aid) in the form of a return-flow cutoff and an outflow cutoff comprising a hose integrated into the exit pipe which is designed to be kinked for cutoff. Because of the weight which has to be moved during handling, a container having a volume of the order of two liters is preferred.

Thus, the invention provides an applicator which is designed to be fitted with a container comprising a filling aid, for example in the form of a funnel, which also forms an outflow cutoff, a dosing valve or the like and a closure which is designed for ergonomically favorable and smooth operation. This ensures that the floor treatment preparation can be applied under control to the floor in the particular quantity required by the user as a function of the area to be treated.

The container comprises a permanently open filling funnel so that it may be refilled without any handling difficulties, preferably one-handedly, making it sufficient to carry only a relatively small quantity of floor treatment preparation. Since enough fresh treatment preparation is available in any position of the floor wiper means, the wiping head may be designed to take up a minimum quantity of floor treatment preparation so that the corresponding loss is also minimal.

The filling funnel of the container has such a geometric form that it comprises a cutoff preventing the treatment preparation from flowing out and, at the same time, a ventilation opening. Accordingly, the filling funnel is preferably formed in one piece in such a way that, even when the appliance or rather its handle is rocked, the filling funnel forms a safe cutoff against the escape of treatment preparation, but is always ready to take in fresh treatment preparation.

The applicator container according to the invention may be clipped or press-fitted onto handle means such as the handle of a known floor wiper, for example by means of a groove machined or formed in its rear wall. In this case, it is favorable to provide a hose coupler or nipple at the lowest point of the storage container in operation and to connect the hose coupler via an elastic hose, more especially of silicone, to an outlet nozzle directed onto the floor.

With many floor treatment preparations, difficulties are involved in designing a valve which continues to function efficiently after buildup of dried preparation. According to another aspect of this invention this problem is solved by using the valve function of a kink in the connecting hose. The kink may be actuated from the grip of the appliance handle, for example by means of a Bowden cable, or the like. The bias of the Bowden cable is preferably such that a kink formed in the elastic hose normally prevents any afterflow of treatment preparation. The user may thus control the afterflow of treatment preparation to meet particular requirements by straightening the kink to a varying degree, more especially by selecting the tension generated by the Bowden cable.

BRIEF DESCRIPTION OF THE DRAWING

The invention is described in detail in the following with reference to the accompanying drawing, wherein.

DETAILED DESCRIPTION OF THE INVENTION

Figure 1:
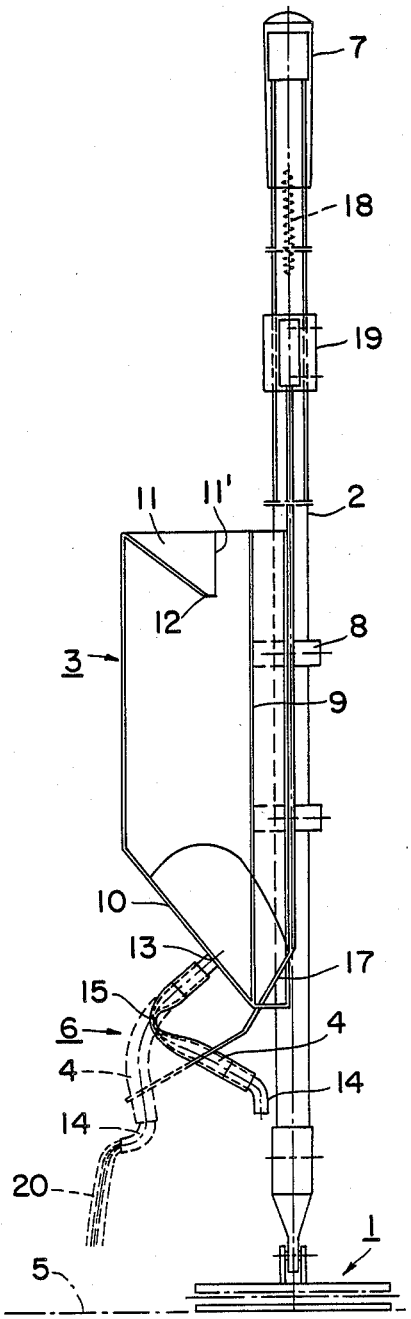
FIG. 1 is a longitudinal section through an appliance for applying floor treatment preparations.
Figure 2:
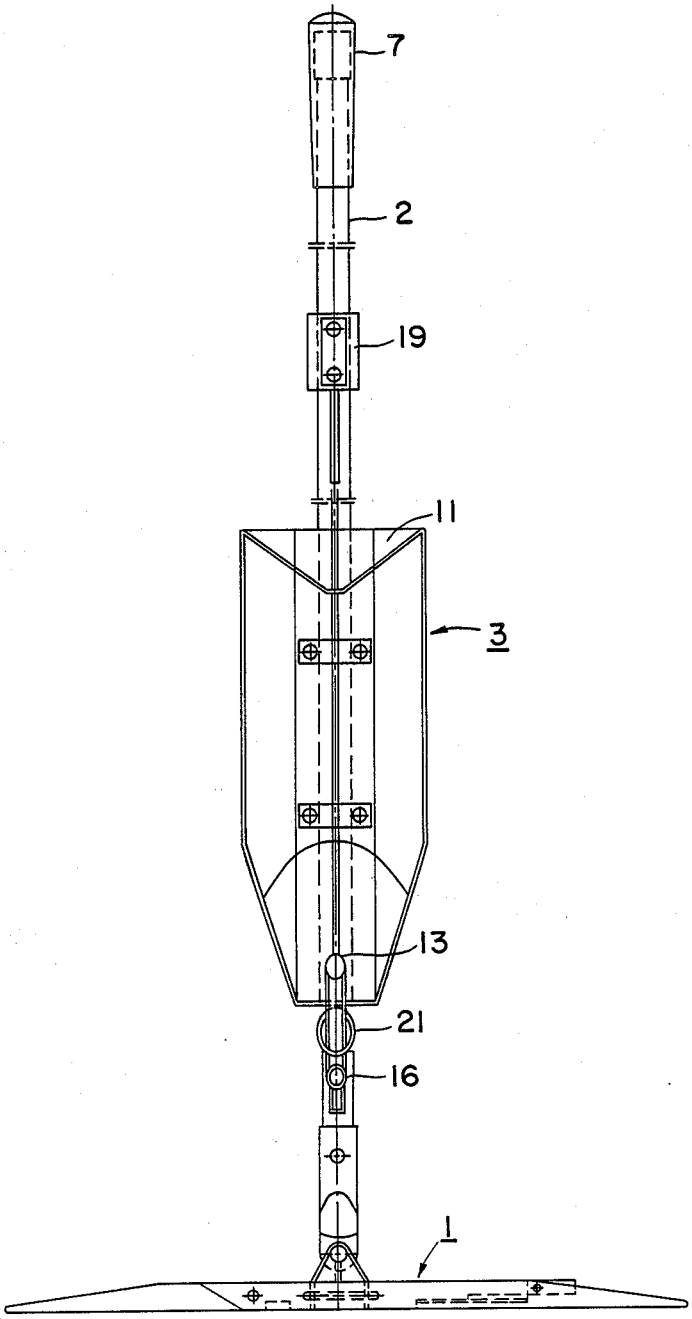
FIG. 2 is a longitudinal section perpendicularly to the plane of FIG. 1.

The appliance according to the invention as shown in FIGS. 1 and 2 comprises a floor wiper globally denoted by the reference 1, an associated handle 2 and a container 3 fixed to the handle 2 with a pipe 6 incorporating a hose 4 and ending above the floor 5. The handle 2 has a grip 7 from which the appliance may largely be operated. The actual floor wiper 1 may be designed, for example, in accordance with the teachings of U.S. Pat. Nos. 4,603,450 and/or 4,680,826, both of which are incorporated herein by reference.

The inventive container globally denoted by the reference 3 may be clipped or press-fitted onto the handle means by attachment means such as a groove 9 machined or formed in its rear wall and containing clips 8. The inventive container is generally aligned upright, and preferably is generally cylindrical. The lower end should be tapered inward toward the handle means to which it is to be attached, bearing in mind that the hose coupling 13 should be located so that all liquid floor treatment preparation in the container will drain through it, when the handle is angled for use. In operation, the container 3 hangs under the handle means 2 at the center between the floor 5 and the in-use obliquely angled handle means 2 in such a way that the base 10 of the container is substantially parallel to the floor 5. The container 3 comprises a filling funnel 11, having a back wall 11'. The associated funnel outlet 12 to the container 3 is intended to extend as far as the highest point of the liquid level when the appliance is positioned obliquely to the floor 5. This construction ensures that, on the one hand, a permanently open filling aid is present while, on the other hand, liquid is unable to flow out the funnel. Even when the handle means 2 has to be lowered more than usual such as for wiping raised surfaces and/or when sudden movements prolduce waves in the liquid in the container 3, no liquid flows out of the funnel. Another effect of the permanently open filling opening is that the container 3 is ventilated commensurately with the (controlled) outflow of liquid, avoiding the vacuum formations that might occur if it were closed.

In the embodiment illustrated, the outflow of liquid from the container 3 does not take place through standard valves or cocks because even the smallest traces of residual floor treatment liquid would dry there and could cause blockages. Instead, a special valve in the base 10 of the container or at the lowest point with an angled hose coupler or nipple 13 projecting into the open is provided as the outlet for the floor treatment liquid. An elastic hose 4, which may be about 7 cm long and made of silicone, is fitted onto the hose coupler 13. At its other ends, the hose is pushed over an approximately 2 cm long metal tube or nozzle 14 serving as the outlet to the floor 5.

In the embodiment illustrated in FIG. 1, the pipe 6 extending from the container 3 is depicted as closed by kinking means applied to the hose 4. The position without the kink 15 in the hose 4 is shown by dash lines in FIG. 1. The weight of the nozzle 14, and perhaps of the hose 4 itself, should be sufficiently high as to cause the hose 14 to unkink and extend downward toward the floor 5 when the kinking means is relieved.

To control the closing or opening of the container outlet formed by the hose coupler 13 by unkinking or straightening of the hose 4 to a liquid flow effective extent, an eye 16 is provided either in the hose 4 or in the metal tube 14 attached to its outlet, connected to one end of a Bowden cable 17, for example by means of a hook.

By actuation of the Bowden cable 17, it is possible to control the unkinking or automatic straighenting of the hose 4 during application from the grip 7 without the user of the appliance having to stoop to the lower end of the container 3. The Bowden cable 17 may be guided through the interior of the handle means 2, in which instance opening for the Bowden cable 17 is provided in the handle 2 in the region adjacent the hose 4 to be kinked. At the other end of the handle means 2, i.e. in the region of the grip 7, the Bowden cable 17 is kept under tension by means of a helical spring 18 arranged in the handle 2 in the illustrated embodiment so that the hose 4 is normally kinked, i.e. without actuation of the Bowden cable 17, and is thus closed. The Bowden cable 17 may be freed from tension against the force of the helical spring 18 by means of a slideable sleeve 19 fitted onto the handle 2 so that the hose 4 can straighten out and the kink 15 preventing outflow is more or less completely eliminated. The sleeve 19 may be connected either to the helical spring 18 or to the Bowden cable 17 by a stud which runs through a slot in the handle 2. In the embodiment illustrated, both one end of the helical spring 18 and one end of the Bowden cable 17 are connected to the sleeve 19 so that, by pushing the sleeve 19 downwards, the tension of the spring 18 is eliminated and the hose 4 is straightened.

As illustrated in the drawing, the pipe 6 with the metal tube 14 ends above the actual floor wiper 1. Accordingly, when the hose 4 is straightened, or at least partially relieved of its kink, the floor treatment liquid 20 is able to flow out onto the floor 5 in a stream at a distance from the body of the floor wiper 1. For filling or re-emptying, the container 3 may be removed from the handle 2 in the embodiment illustrated. Accordingly, a rotatably mounted ring 21 is provided at the hose coupler 13 to hold the unkinked hose 4 or the pipe 6 as and when required.

The appliance according to the invention in the embodiment illustrated affords the following advantages:

the outflow mechanism may be manually operated from an ergonomically favorable body posture, the entire Bowden cable 17 is accommodated inside the handle and is thus not exposed to soiling or damage, the Bowden cable 17 is readily fastened by a hook at the end of the pulling part and an eye 16 on the pipe 6, the large throughflow openings of the hose olive 13, the hose 4 and the outflow metal tube 14 never lead to blockages, even in the event of incorrect treatment, the container 3 is easy to fit and remove, the container 3 may be filled and re-emptied without difficulty, the container 3 may be rapidly cleaned because it is removably mounted on the handle 2, the container 3 may be made of transparent material, for example polyethylene, so that the filling level is visible, the appliance as a whole is basically suitable for the application of any liquids to horizontal surfaces.

We claim:

1. An applicator for liquid floor treatment preparations adapted to be mounted at its back to the handle of a long-handled floor wiper, comprising:

(A) a longitudinal container for the liquid preparations having liquid inlet means at its top and liquid outlet means near its bottom;

(B) said inlet means comprising a return flow cutoff funnel directed into the container, said funnel being open at all times, and including a lip integral with and proximal to the front of said container, sides sloping from the front towards the back of said container at an angle for terminating at an open mouth located both at a level in said container substantially representing the highest allowable liquid level within said container when said applicator is positioned obliquely to a floor, and sufficiently away from the front of said container, for preventing an outflow of liquid when said container is tilted forward in use, both said open funnel and mouth also providing ventilation for said container;

(C) said outlet means comprising (a) an exit hole in the container, (b) a hose coupler surrounding and projecting distally from said exit hole, (c) a flexible hose removably attached at one end to said coupler and in fluid communication with said container, and (d) a nozzle attached to said hose at its free end; and (D) closing means for releasably kinking said hose sufficiently so that it may be effectively closed to fluid communication.

2. The applicator of claim 1 wherein said container further comprises a planar base downwardly and inwardly tapering from the container front toward the container back at an angle such that said base is approximately parallel to the floor when the container is tilted forward in use, and wherein the exit hole of the container is located within said base.

3. The applicator of claim 1 wherein said container further comprises attachment means for removeably attaching said container to the handle of said floor wiper.

4. The applicator of claim 3 wherein said attachment comprises a longitudinal channel in the container back for receiving the handle of said floor wiper, and holding means for releasably holding said handle within said channel.

5. The combination of the applicator of claim 4 with a long-handled floor wiper, the handle of said floor wiper being received within said longitudinal channel.

6. The applicator of claim 1 wherein said flexible hose is a silicone polymer and said nozzle is metal.

7. The applicator of claim 1 wherein the combined length of said outlet means is such that said nozzle ends above the plane of a floor to be treated, when said container is attached to said handle, and tilted forward in use.

8. The applicator of claim 1 wherein said closing means comprises a Bowden wire, attached at one end to the free end of said hose, and adapted for attachment at its other end toward that end of said handle farthest from the floor wiper, so that creating tension on said other end will kink said hose.

9. The applicator of claim 8 wherein said closing means comprises tension means for creating a permanent tension on said Bowden wire, so that said hose is normally kinked sufficiently to substantially prevent fluid communication through said outlet means.

10. The applicator of claim 8 wherein said tension means comprises a spring.

11. The applicator of claim 10 wherein said spring is a helical tension spring.

12. The applicator of claim 11 wherein said spring is fixedly attached at its lower end to said Bowden wire and adapted to be attached at its upper end to said handle.

13. The applicator of claim 12 wherein a sleeve adapted for slideable axial displacement along said handle is fixedly attached to said Bowden wire in general proximity to said spring.

14. The applicator of claim 13 wherein both the lower end of said spring and the other end of said Bowden wire are fixedly attached to said sleeve.

15. The applicator of claim 14, wherein said outlet means includes said nozzle ends above the plane of the floor to be treated, when said container is attached to said handle, and tilted forward in use; and said closing means comprises a Bowden wire attached at one end to the free end of said hose, and at its upper end to the bottom of a helical tension spring, whose top end is adapted for fixed attachment to the upper end of said handle, said Bowden wire and said spring being coupled through a sleeve adapted for slidable axial displacement along said handle upper end.

16. The combination of the applicator of claim 15 with a long-handled floor wiper, said container being attached at its back to said handle, said handle having a grip distal from the floor wiper, and said sleeve being slideably mounted on said handle proximally below said grip.

17. The combination of claim 16 wherein said handle has a longitudinal conduit and said Bowden wire runs through said conduit.

18. The combination of the applicator of claim 8 with a long-handled floor wiper, said container being attached at its back to said handle, said handle having a grip distal from the floor wiper, and said Bowden wire other end being attached to said handle proximally below said grip.

19. The combination of claim 18 wherein said handle has a longitudinal conduit and said Bowden wire runs through said conduit.

20. The combination of the applicator of claim 1 with a long-handled floor wiper, said container being mounted at its back to said handle.

* * * * *